US011672285B2

(12) United States Patent
Cason

(10) Patent No.: US 11,672,285 B2
(45) Date of Patent: Jun. 13, 2023

(54) SMART SWEATER SUIT

(71) Applicant: Wesley Lydell Cason, Perryville, MD (US)

(72) Inventor: Wesley Lydell Cason, Perryville, MD (US)

( * ) Notice: Subject to any disclaimer, the term of this patent is extended or adjusted under 35 U.S.C. 154(b) by 0 days.

(21) Appl. No.: 17/845,897

(22) Filed: Jun. 21, 2022

(65) Prior Publication Data

US 2022/0312859 A1 Oct. 6, 2022

Related U.S. Application Data

(63) Continuation-in-part of application No. 16/366,188, filed on Mar. 27, 2019, now abandoned.

(51) Int. Cl.
*A41D 1/04* (2006.01)
*A41D 1/00* (2018.01)

(52) U.S. Cl.
CPC ..... *A41D 1/002* (2013.01); *A41D 1/04* (2013.01)

(58) Field of Classification Search
CPC ..... A41D 1/002; A41D 1/14
USPC ..... 2/87, 144
See application file for complete search history.

(56) References Cited

U.S. PATENT DOCUMENTS

| | | | |
|---|---|---|---|
| 3,213,456 | A | 10/1965 | Ludwikowski |
| 3,296,626 | A | 1/1967 | Ludwikowski |
| 3,431,560 | A | 3/1969 | Austin |
| 4,475,252 | A | 10/1984 | Peyser et al. |
| 5,014,359 | A | 5/1991 | Hanson |
| D353,478 | S | 12/1994 | Bowens et al. |
| 5,717,999 | A | 2/1998 | Lurry |
| 5,802,307 | A | 9/1998 | Triplette |
| 5,845,336 | A | 12/1998 | Golde |

(Continued)

FOREIGN PATENT DOCUMENTS

| | | |
|---|---|---|
| CN | 102031695 | 4/2011 |
| CN | 201504572 | 6/2011 |

(Continued)

OTHER PUBLICATIONS

Epaulette, Wikipedia, https://en.wikipedia.org/wiki/Epaulette, accessed on Feb. 18, 2019.

(Continued)

*Primary Examiner* — Gloria M Hale
(74) *Attorney, Agent, or Firm* — Swift & Swift, Attorneys at Law P.L.L.C.; Stephen Christopher Swift

(57) ABSTRACT

A smart sweater suit made of sweater material, such as cotton, wool, polyester, or any other suitable fabric. It can be rain-proofed or adapted for use in all weather. There are fringed epaulettes on the shoulders removably attached by hook and loop fasteners. There are pockets for an electronic device capable of interactive voice communication and answering questions posed by the wearer, which may be sold in combination with the suit, and for a laptop computer and a cell phone. In a first preferred embodiment, it has a conventional collar, with a button-down front. The waistband has belt loops. In a second preferred embodiment, the smart sweater suit is made of the same material, but the top is a pullover with no buttons, and a turtleneck. The ends of the sleeves can be elastic or an elastic and drawstring combination. The suit pants have an elastic waistband and drawstring.

20 Claims, 14 Drawing Sheets

(56) References Cited

U.S. PATENT DOCUMENTS

| | | | | |
|---|---|---|---|---|
| D438,692 | S | 3/2001 | Digby | |
| D456,590 | S | 5/2002 | Gerson | |
| D511,237 | S | 11/2005 | Johnson et al. | |
| 7,013,489 | B1 | 3/2006 | McGrath | |
| 7,376,979 | B2 | 5/2008 | Nilsen | |
| D581,134 | S | 11/2008 | Williams | |
| D592,379 | S | 5/2009 | Harrison | |
| 7,886,368 | B2 | 2/2011 | Hood | |
| 8,898,813 | B2 | 12/2014 | Davis | |
| D960,512 | S * | 8/2022 | Cason | D2/743 |
| 2007/0017008 | A1 | 1/2007 | Snedeker et al. | |
| 2013/0219582 | A1 | 8/2013 | Harris, III | |
| 2017/0280797 | A1 | 10/2017 | Bayliss | |

FOREIGN PATENT DOCUMENTS

| | | |
|---|---|---|
| CN | 202999416 | 6/2013 |
| CN | 205902848 | 1/2017 |
| DE | 255811 | 7/1977 |
| EP | 1 454 363 A1 | 6/2004 |
| KR | 2014-0035863 | 3/2014 |

OTHER PUBLICATIONS

Akarmy, Akarmy Must Way Men's Cotton Casual Military Camo Combat Work Cargo Pants, Aug. 24, 2018, https://www.amazon.com.

WWII Impressions, Inc. Jacket, Utility, USMC, P44444, Green, Jun. 7, 2016, https://wwwIIImpressions.com/products/457.

* cited by examiner

SMART SWEATER SUIT

CROSS REFERENCE TO RELATED APPLICATION

This application is a Continuation-In-Part of Regular Utility patent application Ser. No. 16/366,188, filed Mar. 27, 2019, which is incorporated herein by reference.

BACKGROUND OF THE INVENTION

1. Field of the Invention

The present invention relates to suits made from fabric suitable for use in sweaters, with removable epaulettes (also spelled epaulets) on the shoulders, wherein said epaulettes have straight, rigid members.

2. Description of the Prior Art

There are previous inventions that combine features of sweaters and suits, but not that are the same as the present invention.

U.S. Pat. No. 3,213,456, issued on Oct. 26, 1965, to Stanley W. Ludwikowski, discloses rainwear, including a sweater that is waterproofed, and in the form of a men's suit. The instant invention is distinguishable, because it uses hook and loop fasteners (commonly known by the trademark VELCRO).

U.S. Pat. No. 3,296,626, issued on Jan. 10, 1967, to Stanley W. Ludwikowski, discloses a two-piece garment for wear during rainy weather. The instant invention is distinguishable, because it uses hook and loop fasteners.

U.S. Pat. No. 3,431,560, issued on Mar. 11, 1969, to Russell A. Austin, discloses a shoulder guard for football players, having epaulets 38 that are attached by rivets 41. The instant invention is distinguishable, because the epaulets are attached by hook and loop fasteners.

U.S. Pat. No. 4,475,252, issued on Oct. 9, 1984, to Eliot Peyser and Miriam Peyser, discloses a garment having adjustable sleeve means, with epaulets that are threaded through loops and fastened by snap closures. The instant invention is distinguishable, because in it the epaulets are attached by hook and loop fasteners.

U.S. Pat. No. 5,014,359, issued on May 14, 1991, to James M. Hanson, discloses a vest and backpack combination, having epaulets 190 and 192 that can be attached by Velcro (column 6, lines 45-48). The instant invention is distinguishable, because it is made of a sweater material.

U.S. Pat. No. 5,717,999, issued on Feb. 17, 1998, to Clay A. Lurry, discloses modular clothing, having epaulets 15 that are attached by hook and look fasteners 14 (column 3, lines 60-63). It has cuffs and pants that may have elastic or drawstring closures. The instant invention is distinguishable, because it is made of a sweater material.

U.S. Pat. No. 5,802,307, issued on Sep. 8, 1998, to Walter W. Triplette, discloses fencing jackets made from electrically conductive threads. The instant invention is distinguishable, because it does not require electrically conductive threads.

U.S. Pat. No. 5,845,336, issued on Dec. 8, 1998, to Paul J. Golde, discloses an all-weather ventilated and protective garment. The instant invention is distinguishable, because it has epaulettes having fringes formed by straight, rigid members.

U.S. Pat. No. 7,013,489, issued on Mar. 21 2006, to Leonard J. McGrath, discloses a liner and garment ensemble for thermal wear and anti-exposure suits. The instant invention is distinguishable, because it has epaulettes having fringes formed by straight, rigid members.

U.S. Pat. No. 7,376,979, issued on May 27, 2008, to Michael B. Nilsen, discloses an exercise garment with numerous small pockets, including minipockets at the ankles. The garments may be sweaters or suits (column 4, lines 35-37). The instant invention is distinguishable, because it has epaulets and can be rain proofed.

U.S. Pat. No. 7,886,368, issued on Feb. 15, 2011, to Tony Hood, discloses a garment backpack. The instant invention is distinguishable, because it has epaulettes having fringes formed by straight, rigid members.

U.S. Pat. No. 8,898,813, issued on Dec. 2, 2014, to Carol Ann Davis, discloses an easy-access, individual needs, one-piece garment. The instant invention is distinguishable, because it has epaulettes having fringes formed by straight, rigid members.

U.S. Patent Application No. 2007/0017008, published on Jan. 25, 2007, to Julie Snedeker et al, discloses two-piece protective suit for hazardous environments. The instant invention is distinguishable, because it has epaulettes having fringes formed by straight, rigid members.

U.S. Patent Application No. 2010/0313324, published on Dec. 16, 2010, to Nam Kyu Park, discloses a coverall. The instant invention is distinguishable, because it has epaulettes having fringes formed by straight, rigid members.

U.S. Patent Application No. 2013/0219582, published on Aug. 29, 2013, to William Harris, III, discloses a multi-component coverall. The instant invention is distinguishable, because it has epaulettes having fringes formed by straight, rigid members.

U.S. Patent Application No. 2017/0280797, published on Oct. 5, 2017, to Terrence Roy Bayliss, discloses a pocket design for garments, to allow mobile device users hands-free recording, of video, audio and other data. The instant invention is distinguishable, because it has epaulettes having fringes formed by straight, rigid members.

U.S. Design Pat. No. Des. 353,478, issued on Dec. 20, 1994, to Fannie E. Bowens and Donna J. Bowens, discloses a design for a dress. The instant invention is distinguishable, because it is suitable for wear by either sex.

U.S. Design Pat. No. D438,692, issued on Mar. 13, 2001, to Michael W. Digby, discloses a design for a warmup suit, with elastic waistbands, sleeves and ankles, and a drawstring at the waist. The instant invention is distinguishable, because it has epaulets.

U.S. Design Pat. No. D456,590, issued on May 7, 2002, to Karen Gerson, discloses a design for an article of apparel, with a drawstring for the waist. The instant invention is distinguishable, because the top and pants are separate.

U.S. Design Pat. No. D511,237, issued on Nov. 8, 2005, to Ronald Glenn Johnson and Michael Roy Johnson, discloses a design for a denim riding suit. The instant invention is distinguishable, because it is made of sweater material.

U.S. Design Pat. No. D581,134, issued on Nov. 25, 2008, to Mellef Williams, discloses a design for a wedding dress. The instant invention is distinguishable, because it is suitable for wear by either sex.

U.S. Design Pat. No. D592,379, issued on May 19, 2009, to Katherine Aileen Harrison, discloses a design for formal dress. The instant invention is distinguishable, because it is suitable for wear by either sex.

European Patent Application No. EP 1 454 363 A1, published on Jun. 10, 2004, to Peter Conlon, discloses a two-piece adaptable protection suit. The instant invention is distinguishable, because it has epaulettes having fringes formed by straight, rigid members.

German Patent No. 2558118, published on Jul. 7, 1977, to Hinterleitner Werner, discloses a suit with jacket and trousers for sports pilots. The instant invention is distinguishable, because it has epaulettes having fringes formed by straight, rigid members.

Korean Patent No. 2014-0035863, published on Mar. 24, 2014, to Yun Jong Sik, discloses an epaulet attached by hook and loop fasteners. The instant invention is distinguishable, because it is made from a sweater material.

Chinese Patent No. 102031695, published on Apr. 27, 2011, to J. Zhang, discloses hygroscopic wool used in suits and sweaters. The wool is treated with a hydrophilic chemical reagent, to increase its moisture-absorbing rate. The instant invention is distinguishable, because the material is rain proofed (making it less likely to absorb moisture). (Only the English abstract and one drawing are available in the records of the USPTO for this patent.)

Chinese Patent No. 201504572, published on Jun. 16, 2011, to Jiangsu Swoto Garments Co. Ltd., discloses a combat-uniform style business suit with epaulettes. The instant invention is distinguishable, because it may have elastic and drawstring combinations.

Chinese Patent No. 202999416, published on Jun. 19, 2013, to Jiangsu Baihu Textile Science & Technology Co. Ltd., discloses a work suit with epaulettes attached by hidden buttons. The instant invention is distinguishable, because in it the epaulettes are attached by hook and loop fasteners.

Chinese Patent No. 205902848, published on Jan. 25, 2017, to Wang Xiyu, discloses a military uniform in which the epaulet is retained by a metal plate. The instant invention is distinguishable, because in the military version, the epaulettes are attached by hook and loop fasteners.

Epaulette, Wikipedia, https://en.wikipedia.org/wiki/Epaulette, accessed on 18 Feb. 2019, discloses on the seventh page, under "United Kingdom", a photograph with the caption, "Shoulder mark of a contemporary British OG (Olive Green) pullover with RAF Sergeant insignia. This should strap is attached with hook-and-look fastener." But this shoulder strap is distinguishable from a traditional, ornamental epaulette, because it does not have a fringe, as does the epaulette in the instant invention.

AKARMY, AKARMY Must Way Men's Cotton Casual Military Camo Combat Work Cargo Pants, 24 Aug. 2018, https://www.amazon.com, discloses pants with multiple pockets, but does not have a top part, unlike the instant invention.

WWII Impressions, Inc. Jacket, Utility, USMC, P44444, Green, 7 Jun. 2016, https:/wwwIIImpressions.com/products/457, discloses suit with insignia, but does not disclose epaulettes, as does the instant invention.

None of the above inventions and patents, taken either singly or in combination, is seen to describe the instant invention as claimed.

SUMMARY OF THE INVENTION

The present invention relates to clothing for males or females. It comes in different colors and patterns, and is interchangeable with other clothing. It can come in any size. It is ideal for winter civilian or military dress. The smart sweater suit is made of sweater material, such as cotton, wool, polyester, or any other suitable fabric. It can be rain-proofed or adapted for use in all weather. There are fringed epaulettes on the shoulders removably attached by hook and loop fasteners. There are pockets for an electronic device capable of interactive voice communication and answering questions posed by the wearer, which may be sold in combination with the suit, and for a laptop computer and a cell phone.

In a first preferred embodiment, it has a conventional collar, with a button-down front. The sleeves have a conventional type wrist with buttons, but can also be secured about the wrist with an elastic band. The waistband has belt loops. The ankles may be open or may have an elastic band to prevent cold air drafts.

In a second preferred embodiment, the smart sweater suit is made of the same material, but the top is a pullover with no buttons, and a turtleneck. The ends of the sleeves can be elastic or an elastic and drawstring combination. The suit pants have an elastic waistband and drawstring combination. The pants also have large pockets that are low to knee with VELCRO® closures (known generically in the U.S. Patent & Trademark Office as "hook and loop" fasteners). There are mini-pockets at the ankles for small items such as keys. The ankles have elastic closures.

Accordingly, it is a principal object of the invention to provide clothing that combines the comfort of sweaters with the formality of suits.

It is another object of the invention to provide a sweater suit with pockets for electronic devices or other tools.

It is a further object of the invention to combine a sweater suit with an electronic device that can provide real time answers to the wearer's questions.

Still another object of the invention is to combine a sweater suit with an electronic device connected to the Internet and/or Global Positioning System.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

Figure 4:
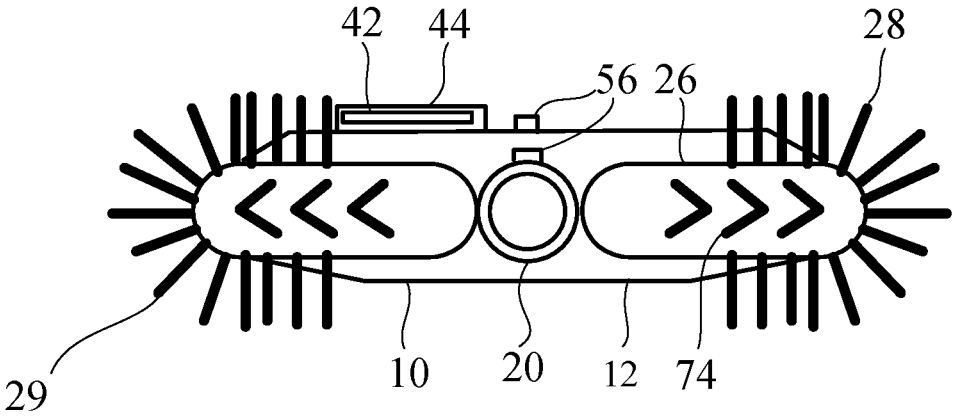
FIG. 4 is a top plan view of the first preferred embodiment of the invention.
Figure 5:
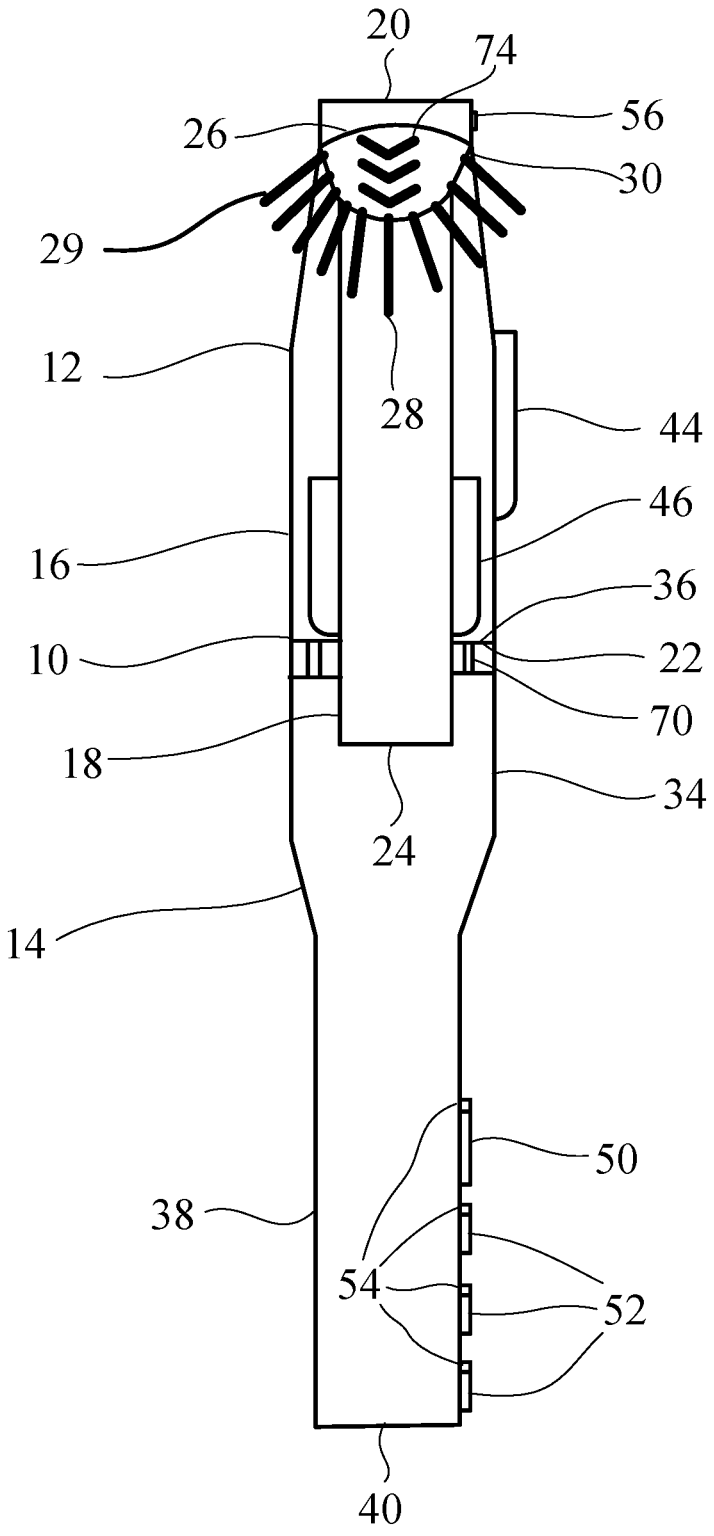
FIG. 5 is a left-side elevation view of the first preferred embodiment of the invention.
Figure 6:
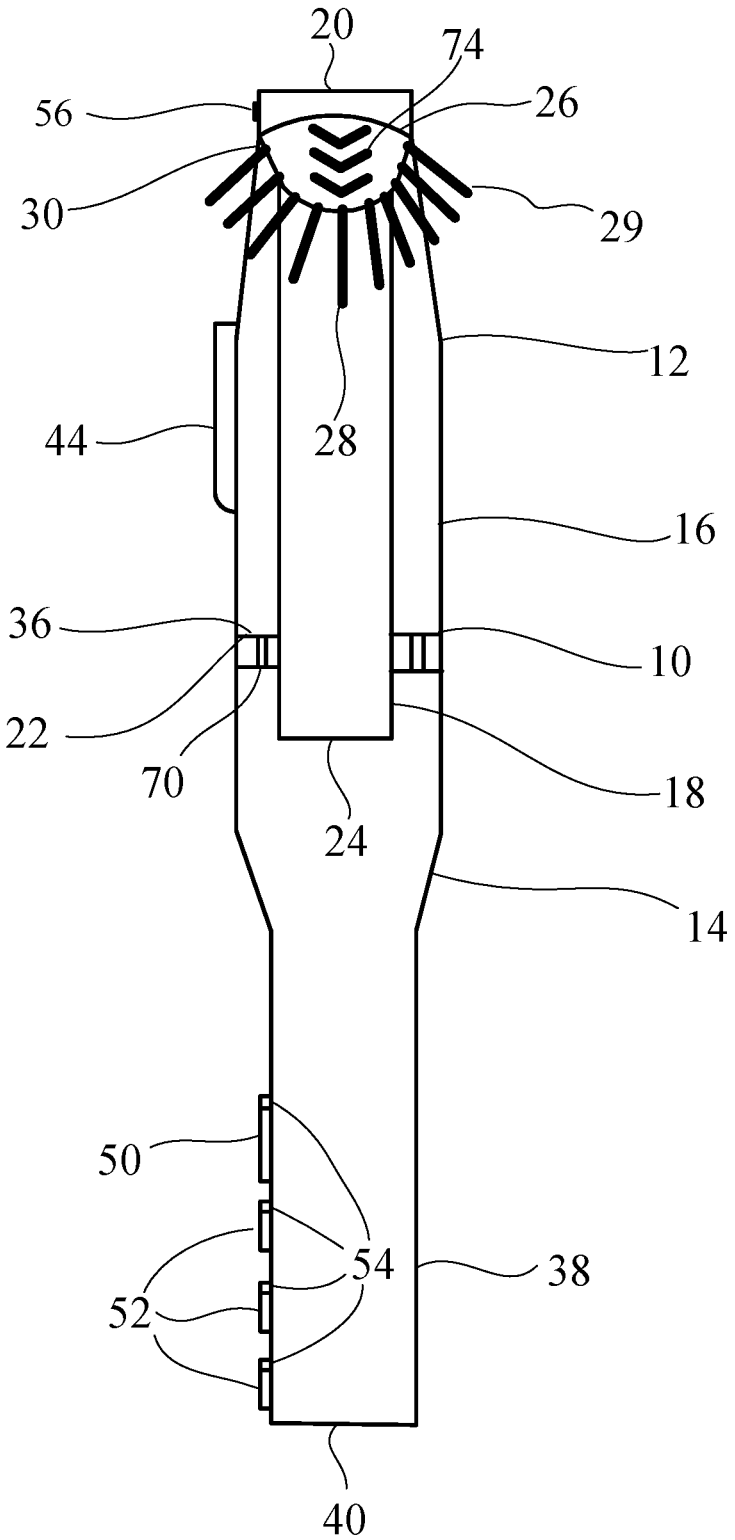
FIG. 6 is a right-side elevation view of the first preferred embodiment of the invention.
Figure 7:
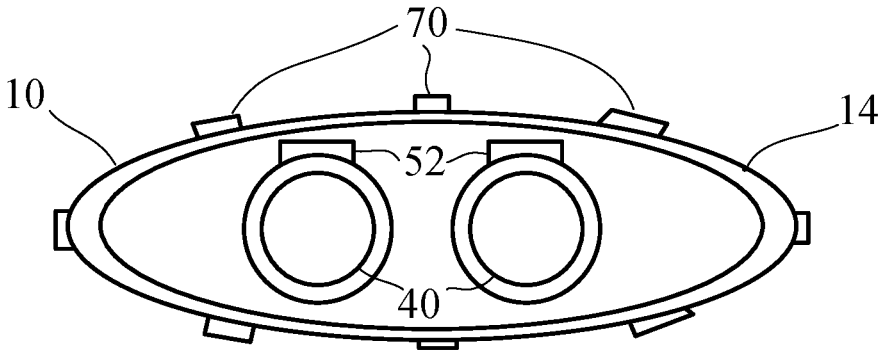
FIG. 7 is a bottom plan view of the first preferred embodiment of the invention.
Figure 11:
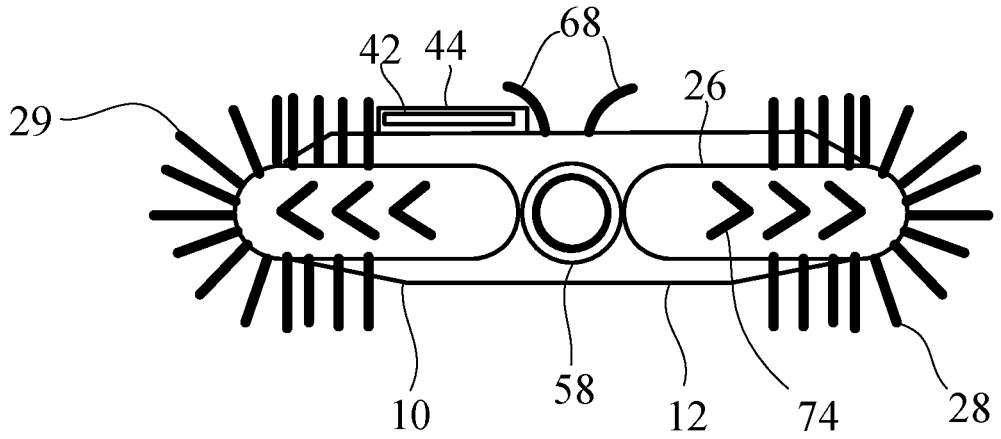
FIG. 11 is a top plan view of the second preferred embodiment of the invention.
Figure 12:
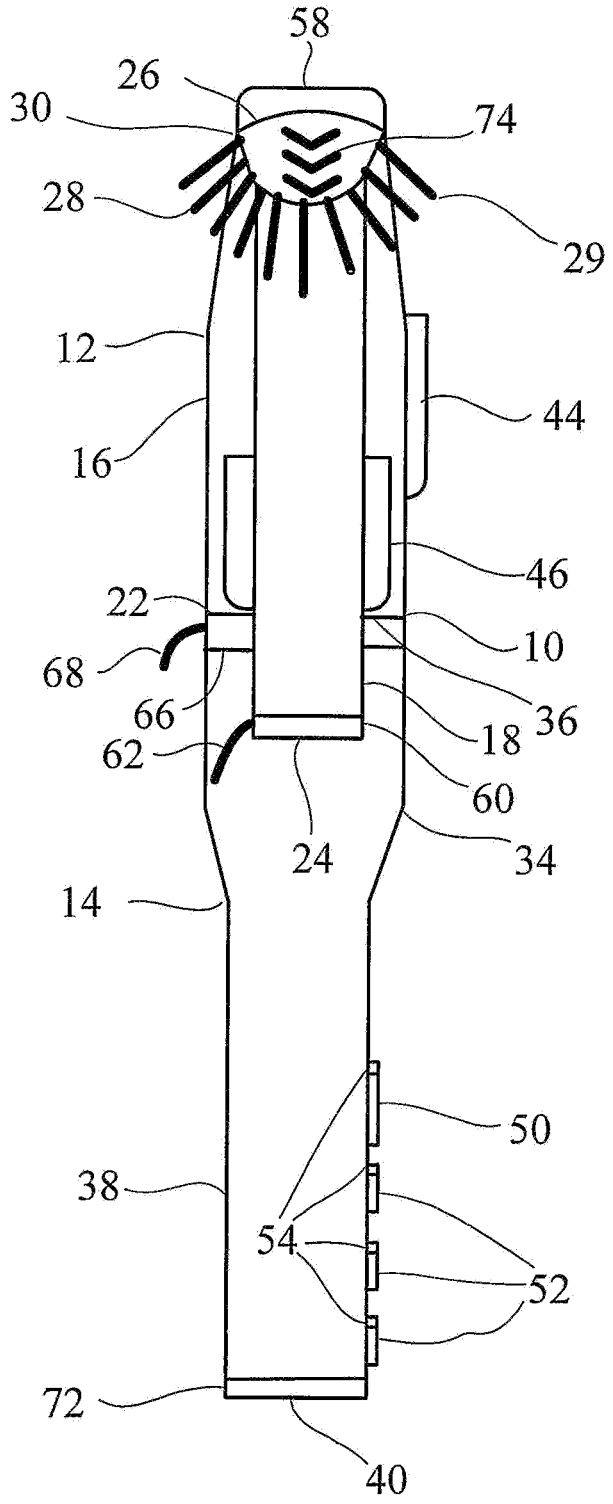
FIG. 12 is a left-side elevation view of the second preferred embodiment of the invention.
Figure 13:
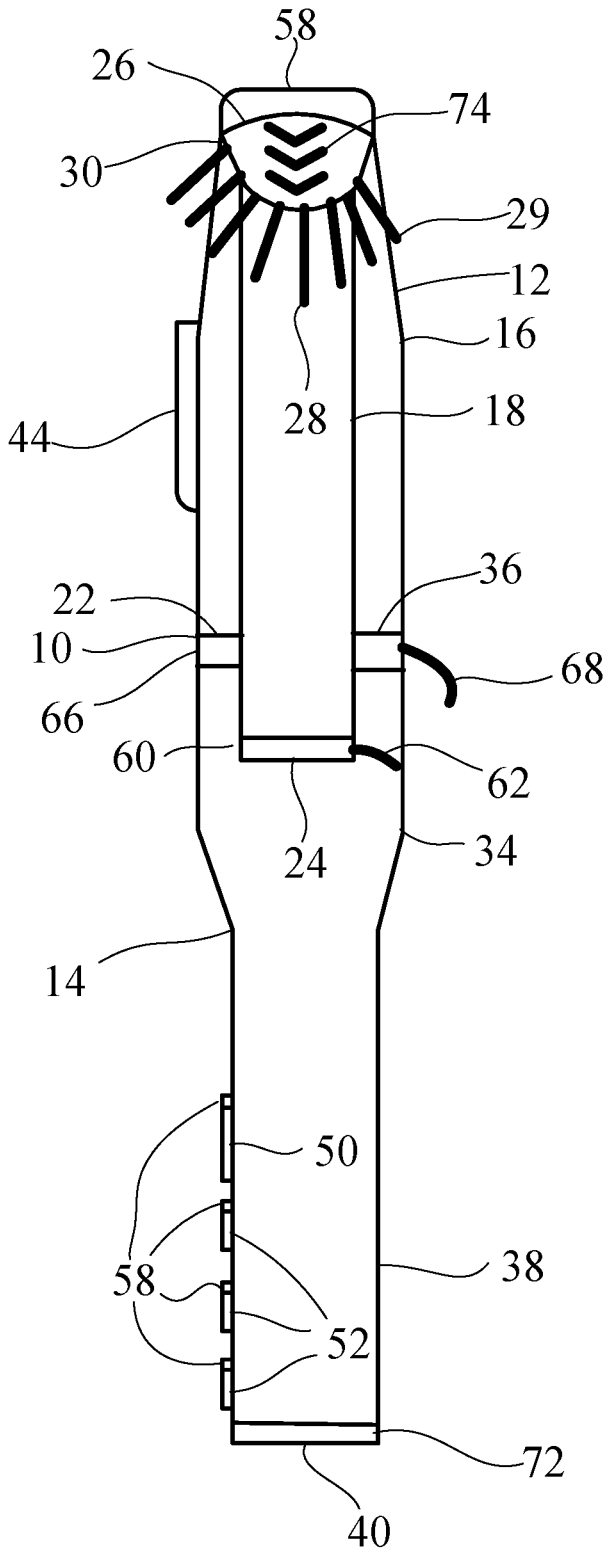
FIG. 13 is a right-side elevation view of the second preferred embodiment of the invention.
Figure 14:
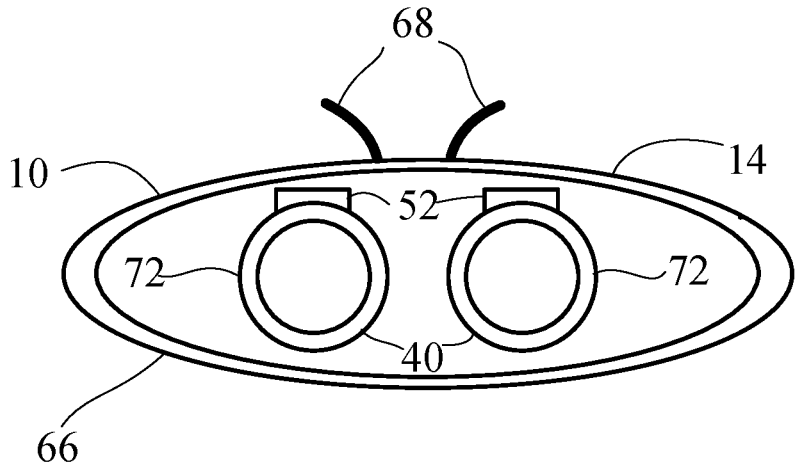
FIG. 14 is a bottom plan view of the second preferred embodiment of the invention.

The broken line in FIGS. 1, 2, 8 and 9 indicates an electronic device that is hidden in those figures, but visible in FIGS. 4 and 11.

Similar reference characters denote corresponding features consistently throughout the attached drawings.

DETAILED DESCRIPTION OF THE PREFERRED EMBODIMENTS

The present invention is a smart sweater suit made of wool, cotton, polyester or other synthetic fabric, or any other fabric suitable for making sweaters. The fabric may be waterproofed to protect from rain.

Figure 1:
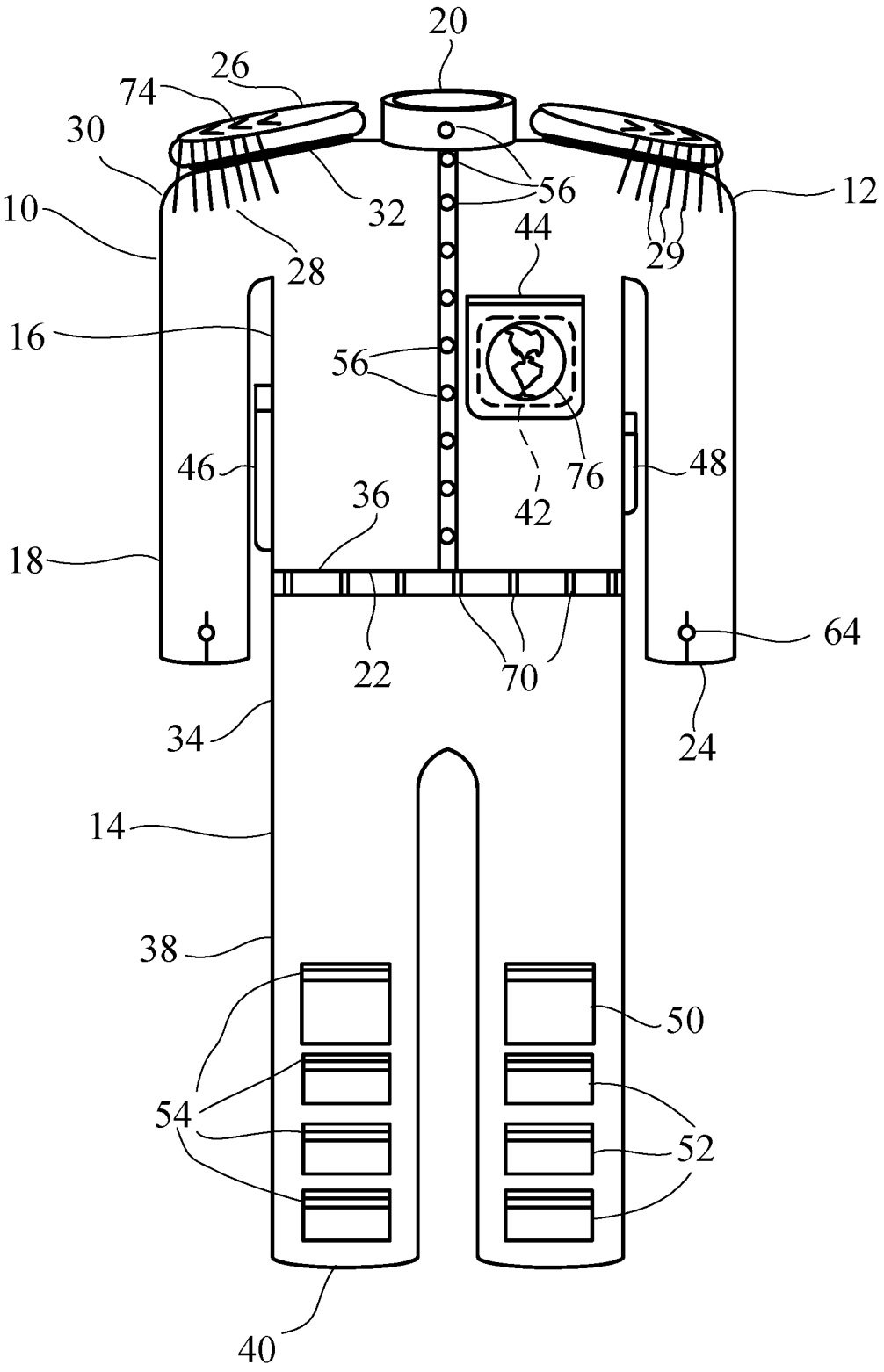
FIG. 1 is a perspective view of a smart sweater suit showing the first preferred embodiment of the invention.
Figure 2:
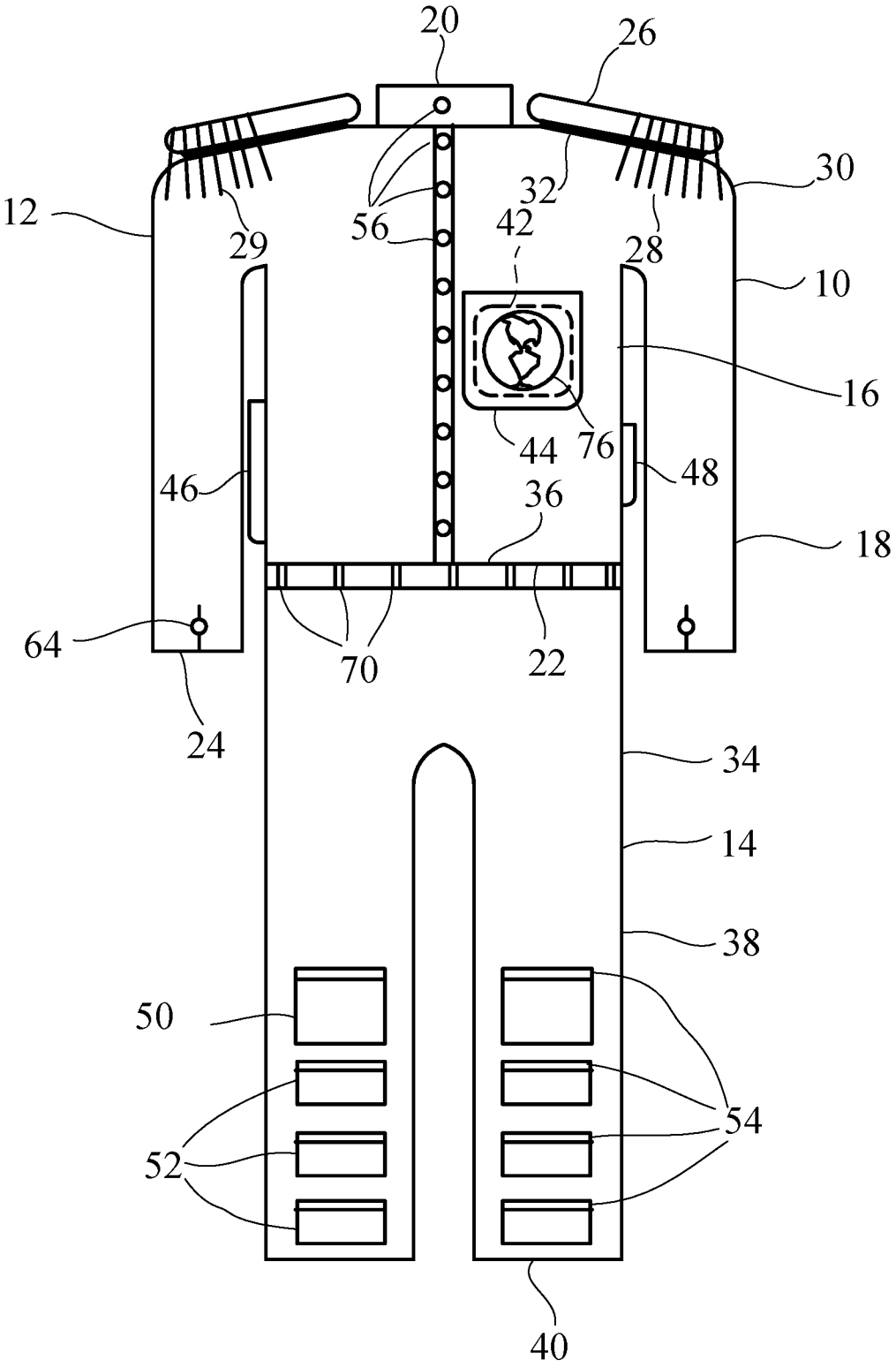
FIG. 2 is a front elevation view of the first preferred embodiment of the invention.
Figure 3:
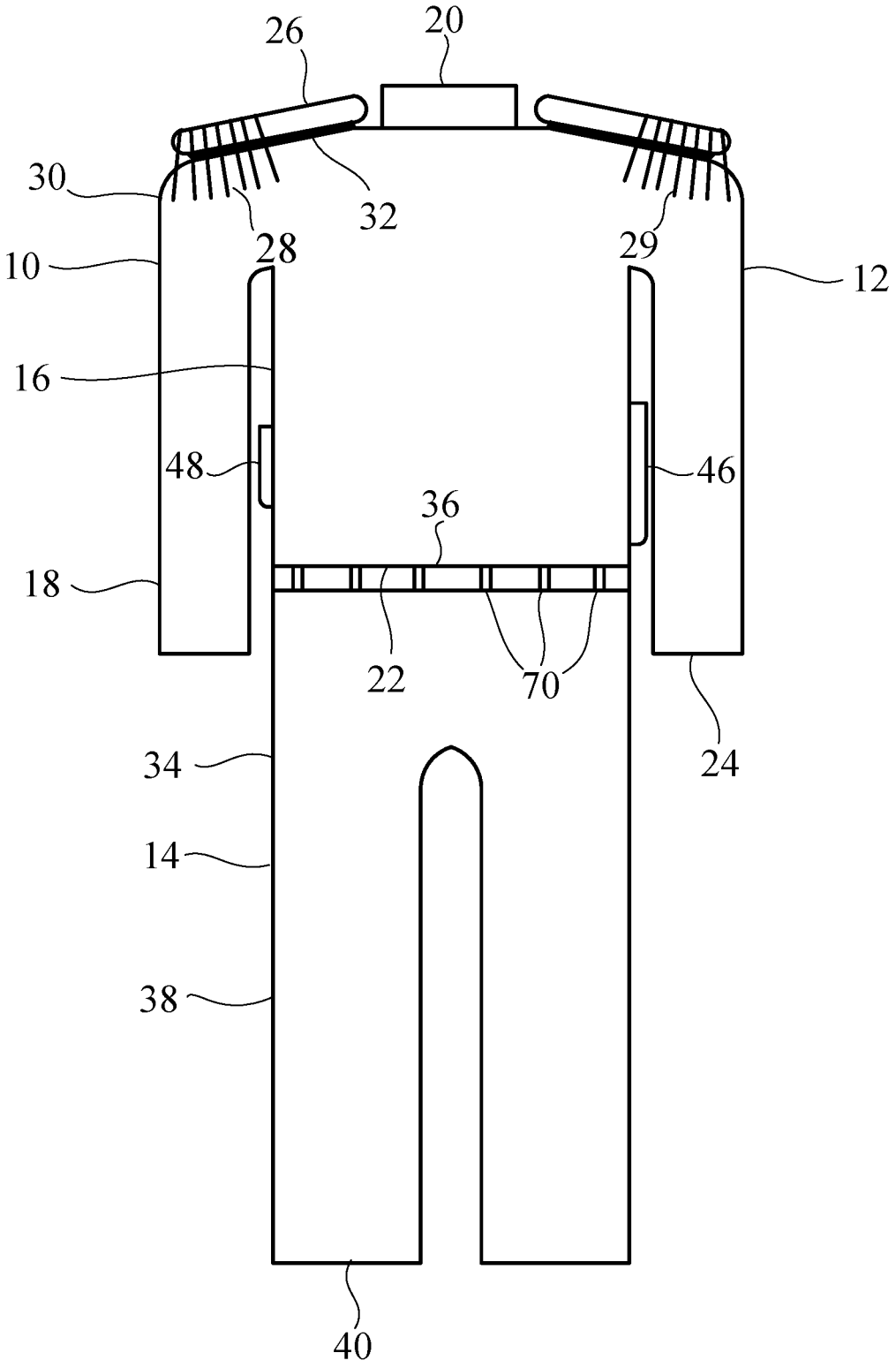
FIG. 3 is a rear elevation view of the first preferred embodiment of the invention.

FIG. 1 is a perspective view of a smart sweater suit showing the first preferred embodiment the invention, showing the smart sweater suit 10, having a top part or shirt 12, and a bottom part or pants 14. The top part comprises a torso 16 and sleeves 18. There is an opening with a collar 20 in the torso for the neck and an opening for the waist 22 of the wearer. There are openings 24 in the sleeves for the hands of the wearer. There are epaulettes 26 with fringes 28 removably retained on shoulders 30 of the torso by hook and loop fasteners 32. The epaulettes have fringes formed by straight, rigid members 29 extending outward in a fixed position from edges of an upper surface of the epaulettes. The straight, rigid members may be formed from plastic, metal, fiber, wood, or any other suitable material.

Insignia 74 optionally may be included on the epaulettes.

The bottom part has a trunk 34 with an opening 36 for the waist of the wearer, and legs 38 with openings 40 for the feet of the wearer.

An electronic device 42, capable of interactive voice communication and answering questions posed by the wearer, is retained in a pocket 44, which is preferably on the left upper front side of the top part. Optionally, there is a design of the earth 76 on the exterior of the pocket. The electronic device may be either removably for permanently retained in the pocket. A larger pocket 46 near the waist of the torso is suitably dimensioned and configured to retain a laptop computer. A smaller pocket 48 near the waist of the torso is suitably dimensioned and configured to retain a cellular telephone. The bottom part has larger pockets 50 in the middle of its legs, and smaller pockets 52 in ends of its legs near their openings for the feet of the wearer, with both the larger and smaller pockets being closable by flaps with hook and loop fasteners 54.

The top part can be opened and closed with buttons 56. The sleeves are secured by buttons 64. There are belt loops 70 around the opening for the wearer's waist in the bottom part.

The first preferred embodiment of the invention is further illustrated by FIGS. 2 through 7, with corresponding reference numbers.

Figure 8:
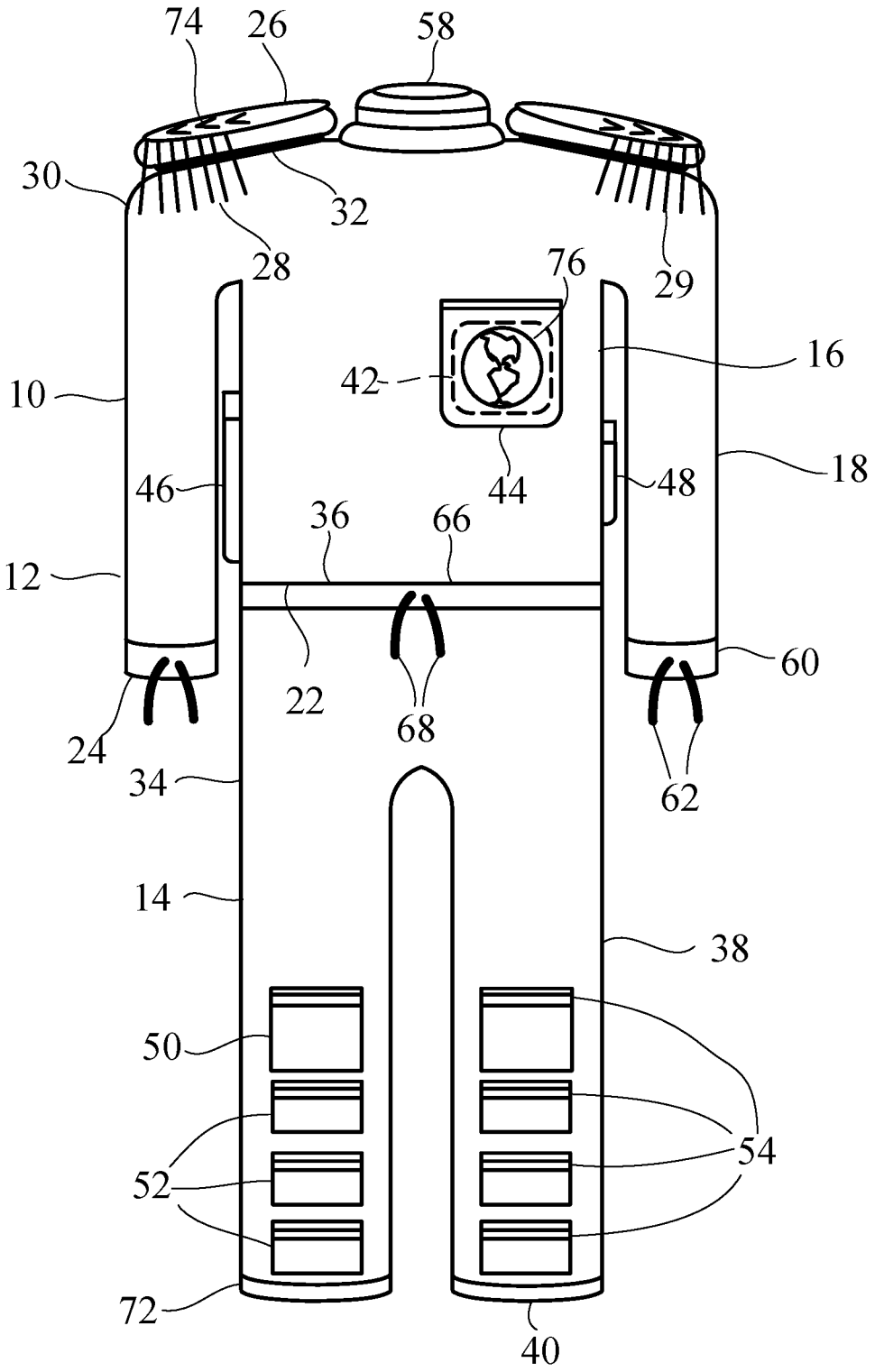
FIG. 8 is a perspective view of a smart sweater suit showing the second preferred embodiment of the invention.
Figure 9:
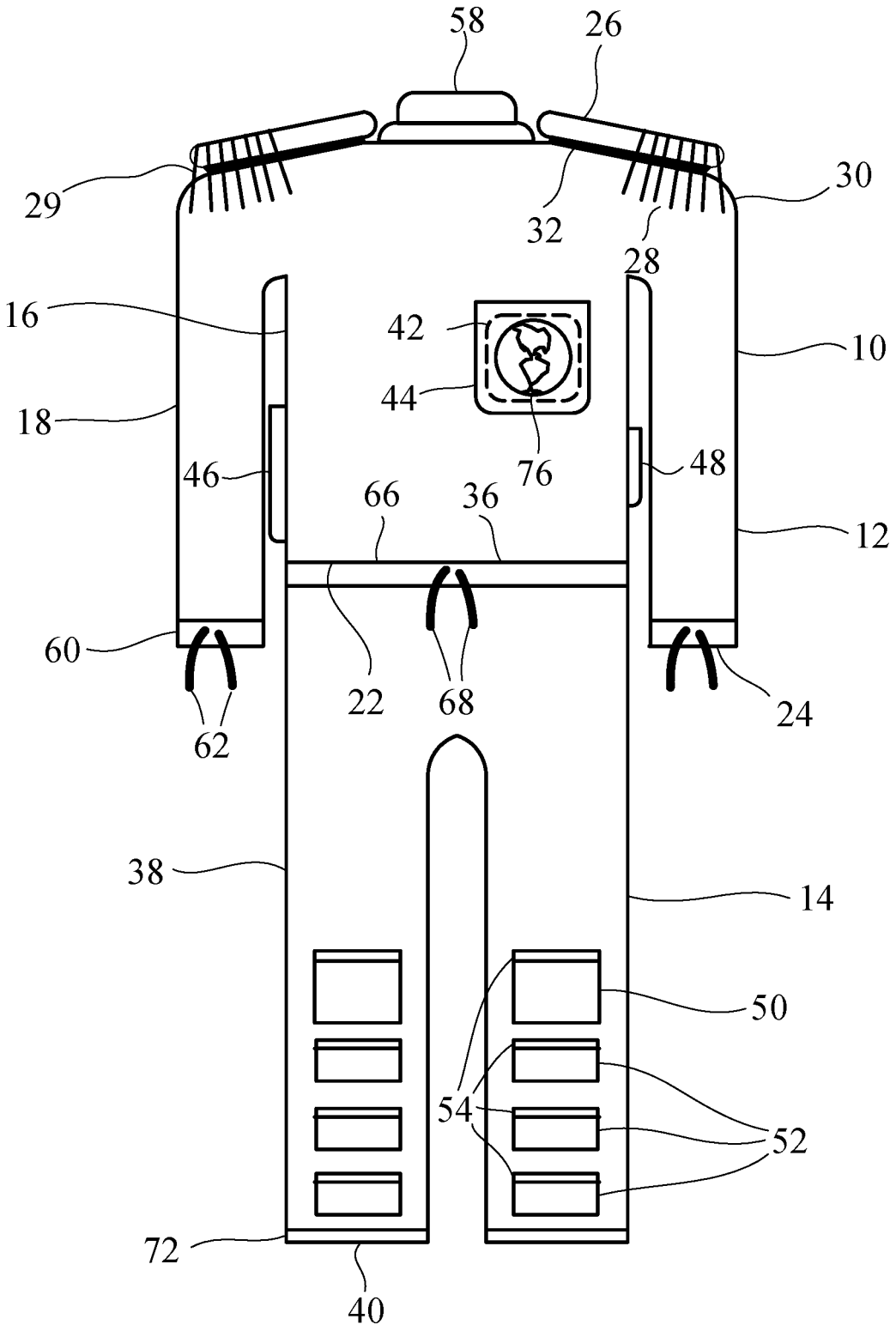
FIG. 9 is a front elevation view of the second preferred embodiment of the invention.
Figure 10:
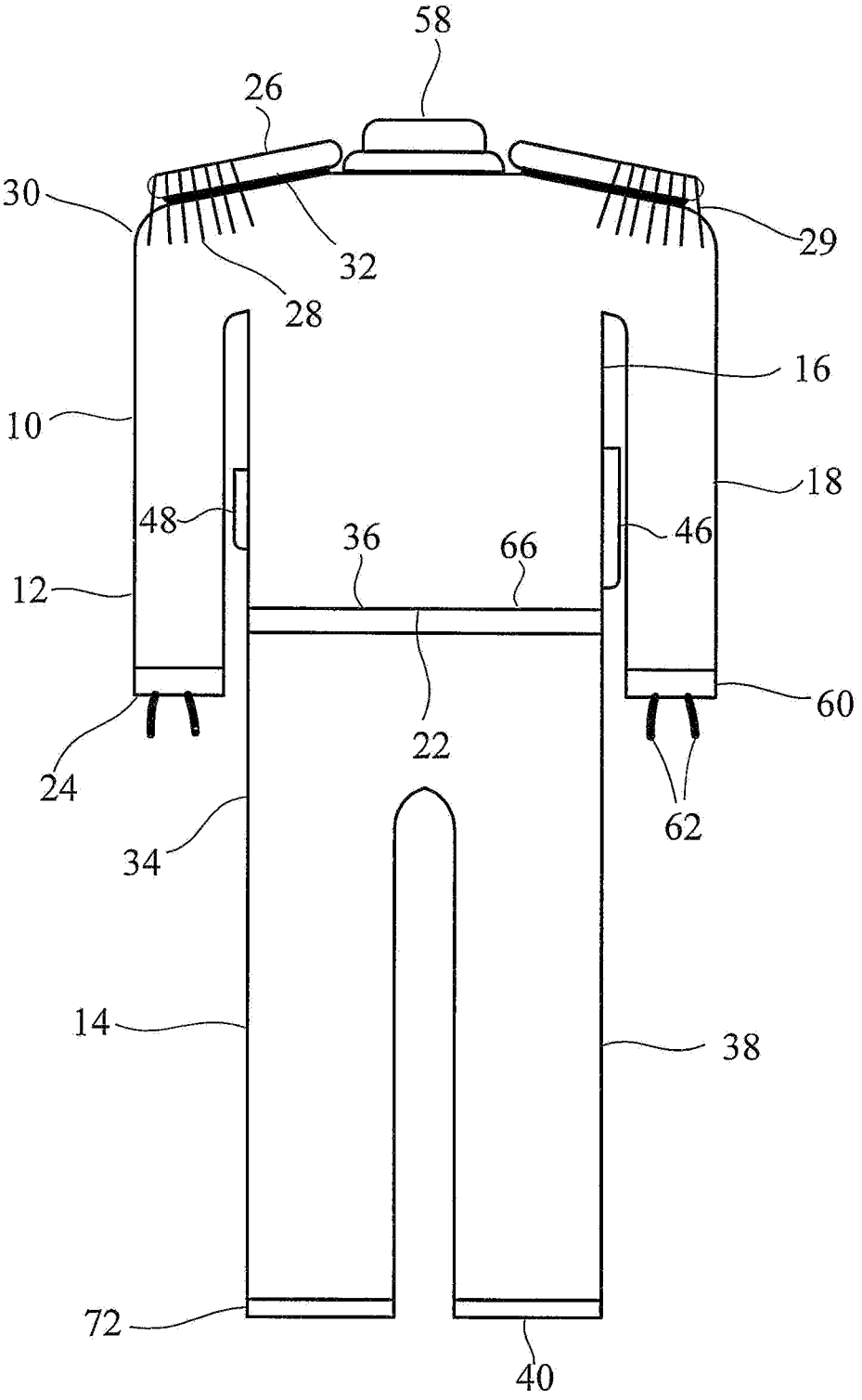
FIG. 10 is a rear elevation view of the second preferred embodiment of the invention.

FIG. 8 is a perspective view of a smart sweater suit showing the second preferred embodiment of the invention. It has no buttons, as the top part is a pullover. The opening for the wearer's neck in the torso of the top part has a high close-fitting turnover collar, i.e., turtleneck 58. The openings in the sleeves of the top part are secured by elastic bands 60 and drawstrings 62. The opening for the wearer's waist in the bottom part is secured by an elastic band 66 and a drawstring 68. The openings for the wearer's feet in the legs of the bottom part are secured by elastic bands 72.

The second preferred embodiment of the invention is further illustrated by FIGS. 9 through 14, with corresponding reference numbers.

For either the first or the second preferred embodiment, the exterior surface of the pocket for the electronic device capable of interactive voice communication has an insignia representing the earth 74. The electronic device capable of interactive voice communication can connect with the Internet, with satellites, and with the Global Positioning System. The suit may be sold separately from the electronic device. The top part and the bottom part may be sold separately.

It is to be understood that the present invention is not limited to the embodiments described above, but encompasses any and all embodiments within the scope of the following claims.

I claim:

1. A smart sweater suit, comprising:

a top part, made of sweater textile material, having a torso with sleeves, with a first opening in the torso for a neck of a wearer and a second opening in the torso for the waist of a wearer, openings in the sleeves for hands of the wearer, and pockets in the torso suitably dimensioned and configured to retain electronic devices, and fringed epaulettes removably retained on shoulders of the torso by hook and loop fasteners, said epaulettes having fringes formed by straight, rigid members, made of material selected from the group comprising plastic, metal, fiber, and wood, extending outward in a fixed position from edges of an upper surface of the epaulettes;

a bottom part, made of sweater textile material, having a trunk with an opening for a waist of the wearer, and legs with openings for feet of the wearer; and an electronic device retained in one of the pockets of the top part, capable of interactive voice communication and answering questions posed by the wearer.

2. The smart sweater suit according to claim 1, wherein:

the pocket for the electronic device capable of interactive voice communication is in an upper front of the torso of the top part of the sweater suit;

a first pocket near a waist of the torso of the top part of the sweater suit is suitably dimensioned and configured to retain a laptop computer; and a second pocket near a waist of the torso is suitably dimensioned and configured to retain a cellular telephone.

3. The smart sweater suit according to claim 1, wherein:

the bottom part has a first set of pockets in its legs, and a second set of pockets in ends of its legs near their openings for the feet of the wearer, with both the first and second set of pockets being closable by hook and loop fasteners, and with the first set of pockets being above the second set of pockets.

4. The smart sweater suit according to claim 1, wherein:

both the top part and the bottom part are made of wool.

5. The smart sweater suit according to claim 1, wherein:

both the top part and the bottom part are made of cotton.

6. The smart sweater suit according to claim 1, wherein:

both the top part and the bottom part are made of synthetic fabric.

7. The smart sweater suit according to claim 1, wherein:

fabric has been waterproofed in both the top part and the bottom part.

8. The smart sweater suit according to claim 1, wherein:

the top part can be opened and closed with buttons.

9. The smart sweater suit according to claim 1, wherein: the opening for the wearer's neck in the torso of the top part has a high close-fitting turnover collar.

10. The smart sweater suit according to claim 1, wherein: the openings in the sleeves of the top part are secured by elastic bands and drawstrings.

11. The smart sweater suit according to claim 1, wherein: the openings in the sleeves of the top part are secured by buttons.

12. The smart sweater suit according to claim 1, wherein: the opening for the wearer's waist in the bottom part is secured by an elastic band and a drawstring.

13. The smart sweater suit according to claim 1, wherein: there are belt loops around the opening for the wearer's waist in the bottom part.

14. The smart sweater suit according to claim 1, wherein: the openings for the wearer's feet in the legs of the bottom part are secured by elastic bands.

15. The smart sweater suit according to claim 1, wherein: an exterior surface of the pocket for the electronic device capable of interactive voice communication has an insignia representing the earth.

16. The smart sweater suit according to claim 1, wherein: the electronic device capable of interactive voice communication can connect with the Internet.

17. The smart sweater suit according to claim 1, wherein: the electronic device capable of interactive voice communication can connect with satellites.

18. The smart sweater suit according to claim 1, wherein: the electronic device capable of interactive voice communication can connect with a global positioning system.

19. A smart sweater suit, comprising:

a top part, made of sweater textile material, having a torso with sleeves, with openings in the torso for a neck and waist of a wearer, openings in the sleeves for hands of the wearer, and pockets in the torso suitably dimensioned and configured to retain electronic devices, and fringed epaulettes removably retained on shoulders of the torso by hook and loop fasteners, said epaulettes having fringes formed by straight, rigid members, made of material selected from the group comprising plastic, metal, fiber, and wood, extending outward in a fixed position from edges of an upper surface of the epaulettes; and a bottom part, made of sweater textile material, having a trunk with an opening for the waist of the wearer, and legs with openings for the feet of the wearer.

20. A smart sweater suit, comprising:

a torso with sleeves, made of a sweater textile material, with openings in the torso for a neck and a waist of a wearer, openings in the sleeves for hands of the wearer, and pockets in the torso suitably dimensioned and configured to retain electronic devices, and fringed epaulettes removably retained on shoulders of the torso by hook and loop fasteners, said epaulettes having fringes formed by straight, rigid members, made of material selected from the group comprising plastic, metal, fiber, and wood, extending outward in a fixed position from edges of an upper surface of the epaulettes.

* * * * *